US008465259B2

(12) United States Patent
Light et al.

(10) Patent No.: US 8,465,259 B2
(45) Date of Patent: Jun. 18, 2013

(54) GAS TURBINE SPINDLE BOLT STRUCTURE WITH REDUCED FRETTING MOTION

(75) Inventors: Kevin M. Light, Maitland, FL (US); Manish S. Gurao, Orlando, FL (US); David M. Shaefer, Chuluota, FL (US)

(73) Assignee: Siemens Energy, Inc., Orlando, FL (US)

( * ) Notice: Subject to any disclaimer, the term of this patent is extended or adjusted under 35 U.S.C. 154(b) by 657 days.

(21) Appl. No.: 12/769,928

(22) Filed: Apr. 29, 2010

(65) Prior Publication Data

US 2011/0268579 A1 Nov. 3, 2011

(51) Int. Cl.
*F04D 29/18* (2006.01)

(52) U.S. Cl.
USPC ..... 416/198 R; 416/200 R; 416/201 R; 416/198 A

(58) Field of Classification Search
USPC ..... 416/198 R, 200, 201 R, 198 AA
See application file for complete search history.

(56) References Cited

U.S. PATENT DOCUMENTS

| | | | | |
|---|---|---|---|---|
| 2,650,017 | A | 8/1953 | Pedersen et al. | |
| 4,245,959 | A * | 1/1981 | Carreno | 416/198 A |
| 5,755,556 | A * | 5/1998 | Hultgren et al. | 416/96 R |
| 6,095,751 | A | 8/2000 | Hirokawa et al. | |
| 6,524,061 | B1 * | 2/2003 | Hirokawa et al. | 416/96 R |
| 6,991,429 | B2 | 1/2006 | Uematsu et al. | |
| 7,114,915 | B2 | 10/2006 | Uematsu et al. | |
| 7,267,527 | B2 | 9/2007 | Fischer et al. | |
| 2009/0003968 | A1 | 1/2009 | Tezuka et al. | |

* cited by examiner

*Primary Examiner* — Igor Kershteyn

(57) ABSTRACT

A spindle bolt structure is provided in a gas turbine engine. The gas turbine engine includes a rotor including a plurality of turbine disks for supporting rows of blades, a torque tube located on a compressor side of the turbine disks, and a seal disk located between the torque tube and a first stage turbine disk. The spindle bolt structure includes a plurality of spindle bolts extending through the turbine disks and disposed offset from a rotational axis of the turbine disks. The spindle bolts include a first terminal end located adjacent to the compressor side of the turbine disks, and a sleeve member is provided extending over a portion of the first terminal end of each spindle bolt and embedded within a compressor side of the seal disk for effecting a reduction in fretting movement of the spindle bolt relative to the seal disk.

17 Claims, 5 Drawing Sheets

GAS TURBINE SPINDLE BOLT STRUCTURE WITH REDUCED FRETTING MOTION

FIELD OF THE INVENTION

The present invention relates generally to rotor structures in gas turbine engines and, more particularly, to a rotor structure including a spindle bolt structure for reducing stresses in turbine spindle bolts of gas turbine engines.

BACKGROUND OF THE INVENTION

Turbomachines, such as gas turbine engines, generally include a compressor section, a combustor section and a turbine section. A rotor is typically provided extending axially through the sections of the gas turbine engine and includes structure supporting rotating blades in the compressor and turbine sections. In particular, a portion of the rotor extending through the turbine section comprises a plurality of turbine disks joined together wherein each turbine disk is adapted to support a plurality of turbine blades. Similarly, a portion of the rotor extending through the compressor section comprises a plurality of compressor disks joined together wherein each compressor disk is adapted to support a plurality of compressor blades. The portions of the rotor in the turbine and compressor sections are connected by a torque tube.

In a known construction of the rotor, the turbine disks are joined together by a plurality of spindle bolts extending longitudinally through the turbine disks in the axial direction. The spindle bolts are subjected to stresses which may comprise preload stresses and stresses resulting from thrust, centrifugal force, and/or thermal effects.

SUMMARY OF THE INVENTION

In accordance with an aspect of the invention, a spindle bolt structure is provided in a gas turbine engine. The gas turbine engine includes a rotor including a plurality of turbine disks for supporting rows of blades, a torque tube located on a compressor side of the turbine disks, and a seal disk located between the torque tube and a first stage turbine disk. The spindle bolt structure comprises a spindle bolt extending through the turbine disks and disposed offset from a rotational axis of the turbine disks. The spindle bolt includes a first terminal end located adjacent to the compressor side of the turbine disks, and a sleeve member is provided extending over a portion of the first terminal end of the spindle bolt and embedded within a compressor side of the seal disk for effecting a reduction in fretting movement of the spindle bolt relative to the seal disk.

In accordance with another aspect of the invention, a spindle bolt structure is provided in a gas turbine engine. The gas turbine engine includes a rotor including a plurality of turbine disks for supporting rows of blades, a torque tube located on a compressor side of the turbine disks, and a seal disk located between the torque tube and a first stage turbine disk. The spindle bolt structure comprises spindle bolts extending through the turbine disks, the spindle bolts being disposed circumferentially around and offset from a rotational axis of the turbine disks. The spindle bolts include a first terminal end located adjacent to the compressor side of the turbine disks. A plurality of holes are provided in the seal disk aligned with corresponding holes in the turbine disks for receiving the spindle bolts. Each hole in the seal disk comprises a stepped portion defining a shoulder between opposing axial faces of the seal disk. A sleeve member extends over a portion of the first terminal end of each of the spindle bolts and is embedded within a compressor side of the seal disk. Each of the sleeve members includes an engagement end engaged on a shoulder within a respective hole in the seal disk for effecting a reduction in fretting movement of the spindle bolt relative to the seal disk.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

DETAILED DESCRIPTION OF THE INVENTION

In the following detailed description of the preferred embodiment, reference is made to the accompanying drawings that form a part hereof, and in which is shown by way of illustration, and not by way of limitation, a specific preferred embodiment in which the invention may be practiced. It is to be understood that other embodiments may be utilized and that changes may be made without departing from the spirit and scope of the present invention.

Figure 1:
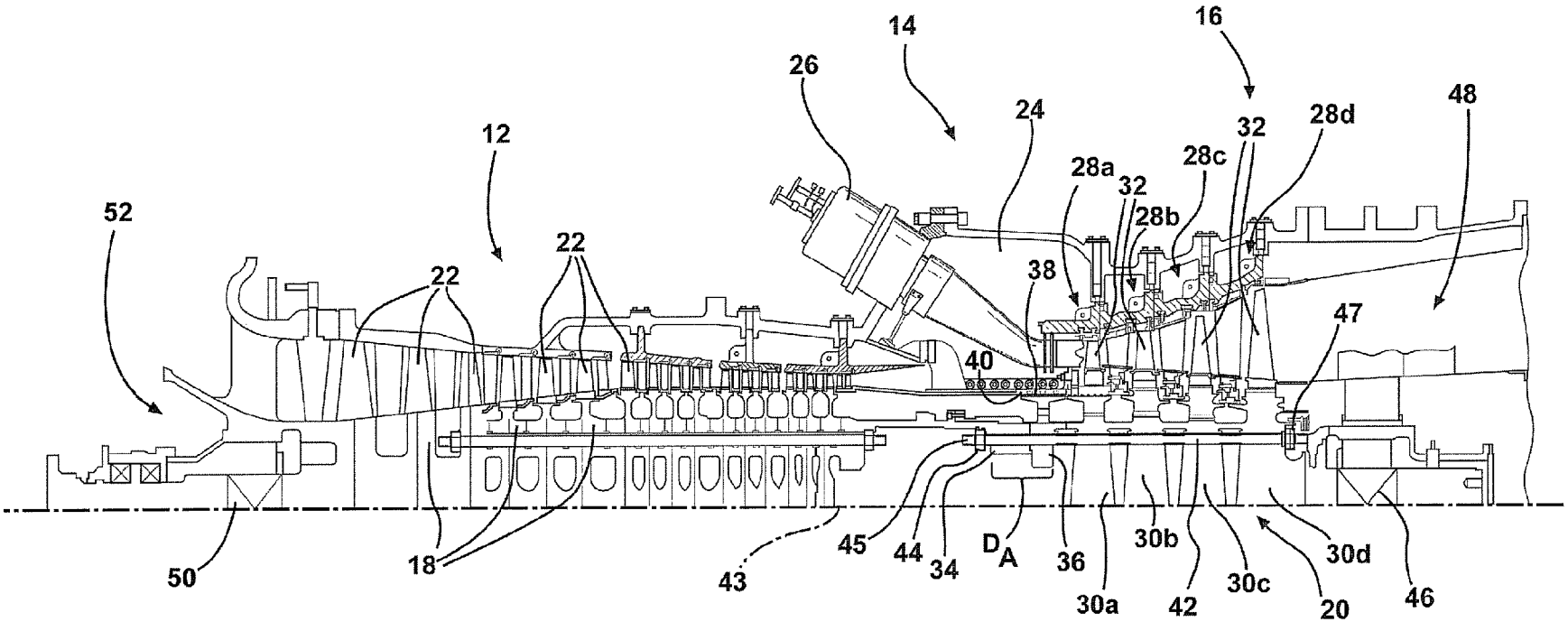
FIG. 1 is an elevational cross-section view of a gas turbine engine illustrating an area of potential spindle bolt failure determined in accordance with an aspect of the present invention.

Referring to FIG. 1, a gas turbine engine 10 is illustrated including a compressor section 12, a combustor section 14 and a turbine section 16. The compressor section 12 comprises a plurality of stages, each stage comprising a compressor disk 18 forming a portion of a rotor 20, and each compressor disk 18 supporting a row of compressor blades 22. Compressed exit air from the compressor section 12 is supplied to a combustor shell 24 of the combustor section 14 and is directed to a combustor 26 where the air is mixed with fuel and ignited to produce hot working gases for producing power in the turbine section 16.

The turbine section 16 includes a plurality of turbine stages, illustrated as first through fourth stages 28*a*, 28*b*, 28*c*, 28*d*. Each of the turbine stages 28*a*, 28*b*, 28*c*, 28*d* comprises a respective one of first through fourth turbine disks 30*a*, 30*b*, 30*c*, 30*d* that define a portion of the rotor 20, and each of the turbine disks 30*a*, 30*b*, 30*c*, 30*d* supports a plurality of blades 32 for converting the energy of the hot working gases into rotational movement of the rotor 20. The rotor 20 further comprises a torque tube 34 extending between the compressor section 12 and the turbine section 16 for transferring output power from the turbine section 16 to the compressor section 12, where a portion of the output power is used to drive the compressor disks 18 and blades 22, and the remaining portion of the output power is used to drive an output device, such as electrical generator (not shown) in a power generation plant.

In addition, the rotor 20 includes a seal disk 36 at a location between the turbine section 16 and the combustor section 14, supported between the first stage turbine disk 30*a* and the torque tube 34. The seal disk 36 includes a rotating seal 38 cooperating with a stationary seal structure 40 adjacent to the combustor shell 24 and forming a seal between the turbine section 16 and the combustor section 14.

A plurality of spindle bolts 42 (only one shown) extend through the turbine disks 30*a-d*, and pass through the seal disk 36 and an end portion 80 (FIG. 2) of the torque tube 34. The spindle bolts 42 are disposed circumferentially around and are offset from a rotational axis 43 of the turbine disks 30*a-d*. The spindle bolts 42 include a first terminal end 45 adjacent the compressor side of the disks 30*a-d* at the torque tube 34, and an opposing second terminal end 47 adjacent an exhaust side of the turbine disks 30*a-d* wherein the first terminal end 45 typically includes a retaining nut 44 engaged against the end 80 of the torque tube 34 (see also FIG. 2). The spindle bolts 42 define a connecting structure spanning the turbine section 16 to join the turbine disks 30*a-d* of the portion of the rotor 20 extending through the turbine section 16. The rotor 20 is supported for rotation on a downstream bearing 46 adjacent to the fourth stage rotor disk 30*d* at an exhaust section 48 of the gas turbine engine 10, and is further supported for rotation on an upstream bearing 50 adjacent to an inlet section 52 of the engine 10.

In accordance with an aspect of the invention, it has been determined that a failure of a spindle bolt 42 may occur in existing turbine engines 10 having a rotor construction, such as is described above with reference to FIG. 1. Specifically, it has been determined that a failure of a spindle bolt 42 may occur in the area generally indicated along an incremental length section $D_A$, located within the seal disk 36 and/or the torque tube 34.

Various factors are typically anticipated in specifying the design for the spindle bolts 42 in order to ensure that the spindle bolts 42 are capable of withstanding stresses exerted in the rotors 20. Such factors include possible effects from stresses induced by loads due to thrust, a centrifugal force, or thermal effects. In addition, a preload stress is typically present on the spindle bolts 42, which comprises a stress induced by a predetermined tension applied on the bolts 42 during assembly of the rotor 20 for maintaining the turbine disks 30*a-d*, seal disk 36 and torque tube 34 joined together.

Known design practice permits specification of the spindle bolts 42 to withstand the conventionally anticipated stresses experienced by the spindle bolts 42 as a result of forces generated by thrust, rotation of the rotor 20 and thermal effects, which are generally referenced herein as baseline or mean stresses. That is, the mean stresses generated by thrust, rotation of the rotor 20 and thermal effects, and substantially due to centrifugal forces with rotation of the rotor 20, are generally predictable, permitting the spindle bolts 42 to be designed, including a factor of safety, to withstand these predicted stresses.

The above noted area of potential failure in the spindle bolt 42, i.e., along the incremental length section $D_A$, indicates an area where a failure may occur in spite of the application of conventional design practice to configure the spindle bolts 42 to withstand the predicted stresses applied through the rotor 20. In accordance with the present invention, a theory of failure and solution are presented to address the unexpected spindle bolt failures at the exemplary location along the incremental length section $D_A$. Specifically, it may be observed that the rotor 20 normally experiences a sag between the bearings 46, 50, resulting in a certain amount of axial elongation of the spindle bolts 42 as the bolts 42 each rotate with the rotor 20 from top-dead-center (TDC) to bottom-dead-center (BDC). For example, a cyclically occurring bolt stretch or elongation in the axial direction $A_1$ is associated with the incremental length section $D_A$ (FIG. 2) of the spindle bolt 42, extending from a stationary end at the nut 44 to a location generally adjacent to the downstream axial face 56 of the seal disk 36. The incremental length section $D_A$ generally will exhibit a minimum axial elongation at TDC, and a maximum axial elongation at BDC.

It is believed that a further factor contributing to failure of the spindle bolt 42 comprises a fretting effect (fretting fatigue) associated with the cyclically occurring lengthwise or axial movement of the spindle bolt 42 relative to the spindle bolt hole 58 in the seal disk 36 and the torque tube 34 as the length of the seal bolt 42 changes in the section $D_A$. The fretting effect comprises an alternating stress, S, produced by high traction forces formed at an interface between the contacting surfaces of the spindle bolt 42 and the spindle bolt hole 58. The traction force is related to the force, F, with which the spindle bolt 42 engages the surface of the spindle bolt hole 58 and the coefficient of friction, p, at the interface between the spindle bolt 42 and the spindle bolt hole 58, i.e., the traction force is proportional to $F \times \mu$, such that the traction force may be decreased by providing increased lubrication (decreased friction) between the spindle bolt 42 and the surface of the spindle bolt hole 58. Further, the magnitude of the fretting effect may be described in terms of the energy produced along the section $D_A$ by the relative axial movement between the spindle bolt 42 and the seal disk 36. Specifically, the energy associated with the fretting effect may be expressed in terms of the energy per unit area, E, as follows:

$$E = S \times L_e$$

where,

S=the contact stress produced by the traction force between the surfaces; and $L_e$=relative displacement of the spindle bolt along $D_A$.

The stress contributing to the failure of the spindle bolt 42 within the seal disk 36 comprises the sum of the mean stress and the fretting stress applied along the section $D_A$.

Figure 3:
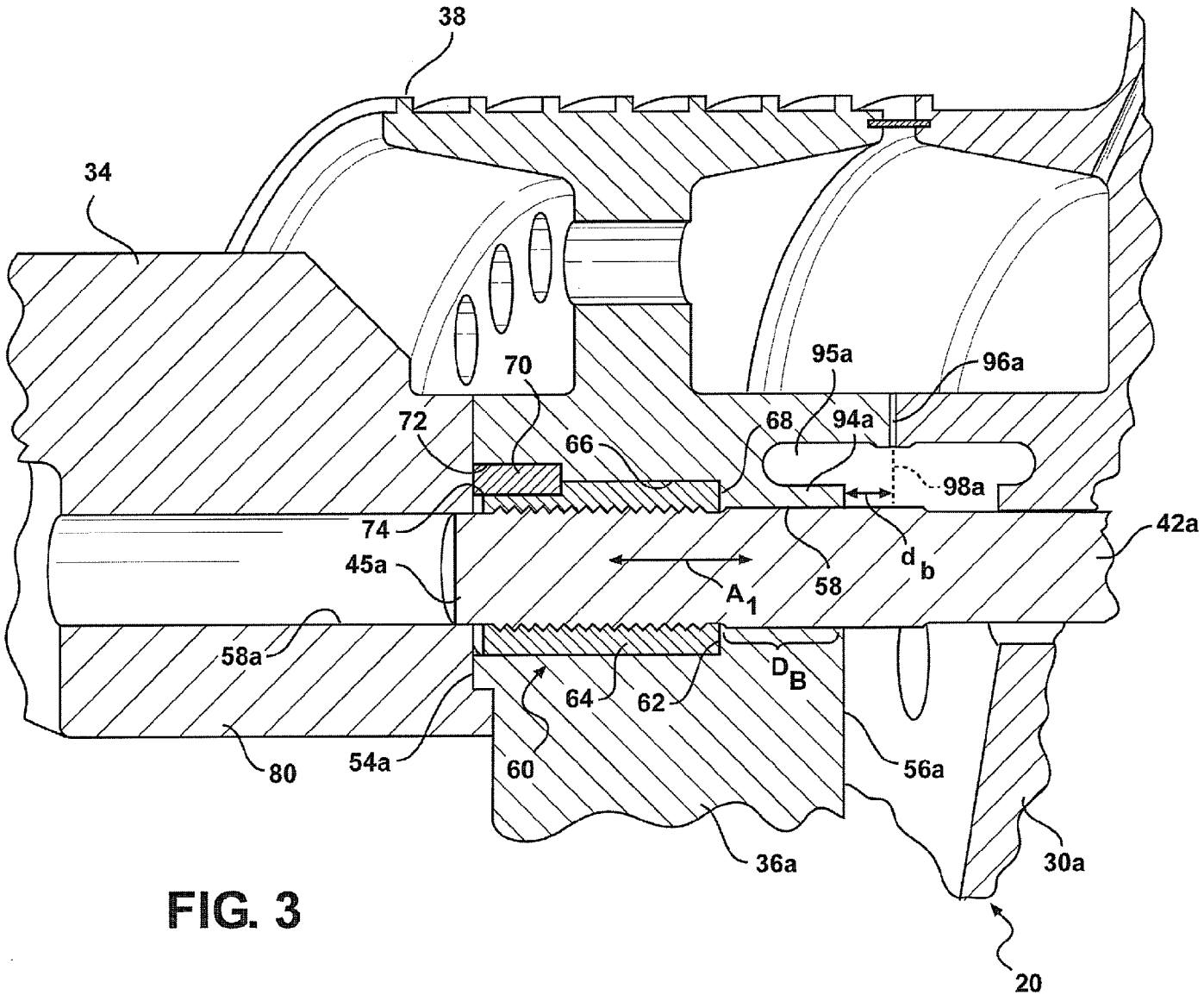
FIG. 3 is an elevational cross-section view of a disk seal portion of a rotor illustrating a spindle bolt structure in accordance with the present invention.

Referring to FIG. 3, a spindle bolt structure 60 is illustrated including a modified spindle bolt 42*a* and seal disk 36*a* which are provided in accordance with the present invention to reduce the relative movement between the surfaces of the spindle bolt 42*a* and the spindle bolt hole 58 defined in the seal disk 36*a*. In particular, the first terminal end 45*a* of the spindle bolt 42*a* extends from a compressor side of the first stage turbine disk 30*a* and passes through the spindle bolt hole 58 to a location adjacent to the upstream axial face 54*a* of the seal disk 36*a*. The spindle bolt hole 58 comprises a stepped portion 62 defining a shoulder, located between the opposing axial faces 54*a* and 56*a* of the seal disk 36*a*.

A sleeve member 64 is positioned within an enlarged diameter portion 66 of the spindle bolt hole 58 and extends over a portion of the first terminal end 45*a* of the spindle bolt 42*a*. The sleeve member 64 is rigidly attached to the first terminal end 45*a* and includes an engagement end 68 that is engaged on the stepped portion 62, i.e., engaged on the shoulder, for defining a fixed upstream end of the disk structure for the turbine section 16. The first terminal end 45*a* preferably comprises a threaded end and the sleeve member 64 is preferably threadably engaged on the first terminal end 45*a*.

An anti-rotation key member 70 may be provided adjacent to the upstream axial face 54*a* and extending into slots 72, 74 formed in the seal disk 36 and the sleeve member 64, respectively. The sleeve member 64 may be formed with a generally cylindrical outer surface, and the key member 70 prevents rotation of the sleeve member 64 relative to the seal disk 36*a*, permitting the spindle bolt 42*a* to be threaded into the sleeve member 64 by rotation of the second terminal end (not shown in FIG. 3) of the spindle bolt 42*a*.

Figure 4:
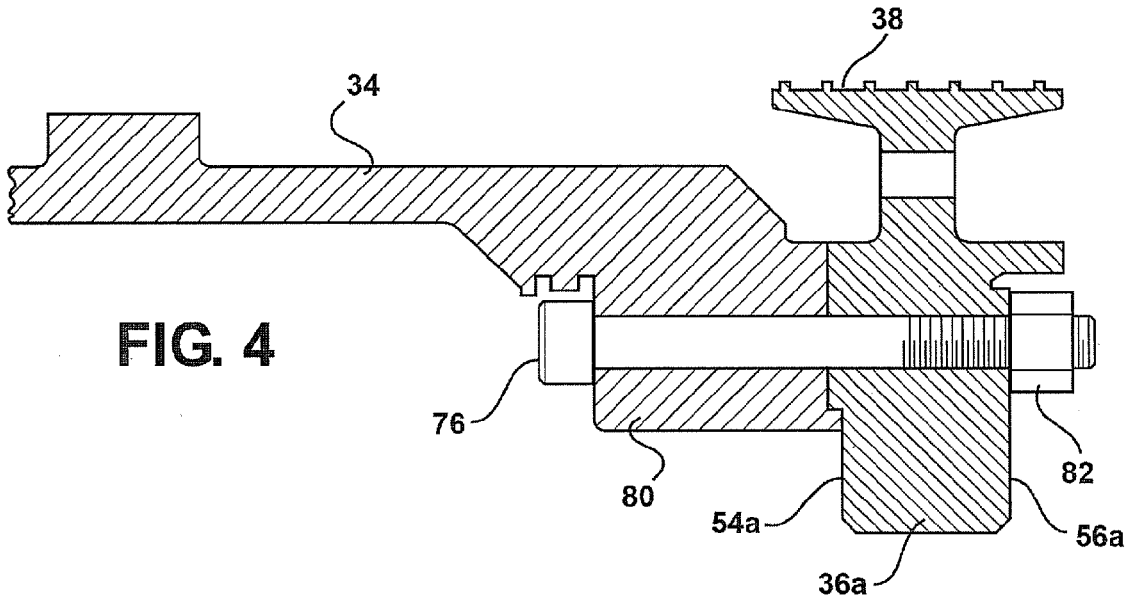
FIG. 4 is an elevational cross-section view of the disk seal shown in FIG. 3 and illustrating a shear bolt connection to the torque tube.
Figure 5:
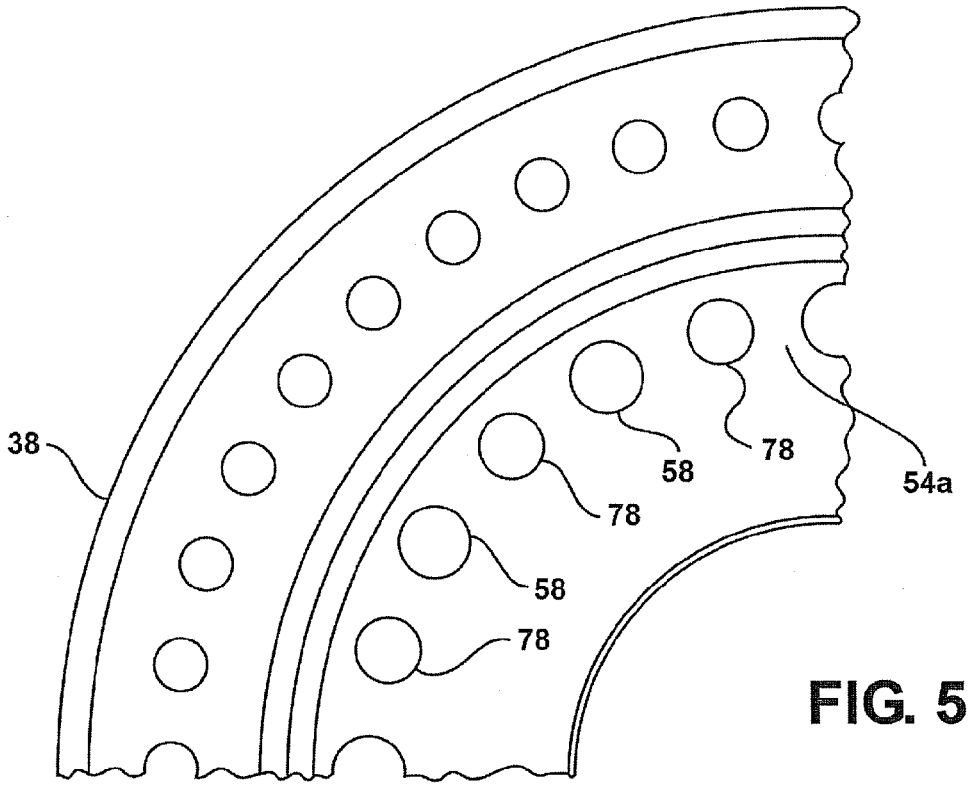
FIG. 5 is an elevational end view of a portion of the disk seal.

The torque tube 34 may comprise spindle bolt hole portions 58*a*, such that the same torque tube may be used for the present spindle bolt structure 60 as is provided for the prior structure described with reference to FIGS. 1-2. However, it should be noted that the spindle bolt hole portions 58*a* in the torque tube 34 are not required for the present invention, in that it is not necessary for the spindle bolts 42*a* of the present spindle bolt structure 60 to extend to the torque tube 34. The torque tube 34 may be supported to the seal disk 36*a* by a plurality of shear bolts 76 (FIG. 4) located circumferentially around and offset from the rotational axis of the rotor 20. The shear bolts 76 extend through the end portion 80 of the torque tube 34 to a location past the downstream axial face 56*a* of the seal disk 36, and include a nut 82 for retaining the shear bolt 76 in place and rigidly connecting the torque tube 34 to the seal disk 36*a*. The shear bolts 76 may be located in shear bolt holes 78 at circumferential locations between the spindle bolt holes 58 in the seal disk 36*a* (FIG. 5).

The spindle bolt structure 60 is configured to provide a reduction in the energy associated fretting at the locations of contact between the spindle bolt 42*a* and the spindle bolt hole 58 within the seal disk 36*a*. In particular, the shoulder defined by the stepped portion 62 is located at a distance $D_8$ from the downstream axial face 56*a* less than one-half the distance between the upstream and downstream axial faces 54*a*, 56*a*. Hence, the length along which relative movement of the spindle bolt 42*a* may take place due to alternative elongation of the spindle bolt 42*a* is substantially reduced with a corresponding reduction of the relative movement between the spindle bolt 42*a* and the seal disk 36*a*. Further, the surface contact area between the spindle bolt 42*a* and the seal disk 36*a* is substantially shortened to comprise the portion of the bolt 42*a* along the length $D_B$, substantially reducing the energy that may be produced due to cyclical fretting movement in the axial direction. For example, the length of the contacting section $D_B$ may be reduced approximately 14% relative to the length $D_A$, which is believed to result in approximately 10% reduction in the relative movement, $L_e$, with a corresponding reduction in contact stress, S, of approximately 49% and a resulting reduction in energy, E, of 4.9% below that provided by the configuration of FIGS. 1 and 2.

Figure 2:
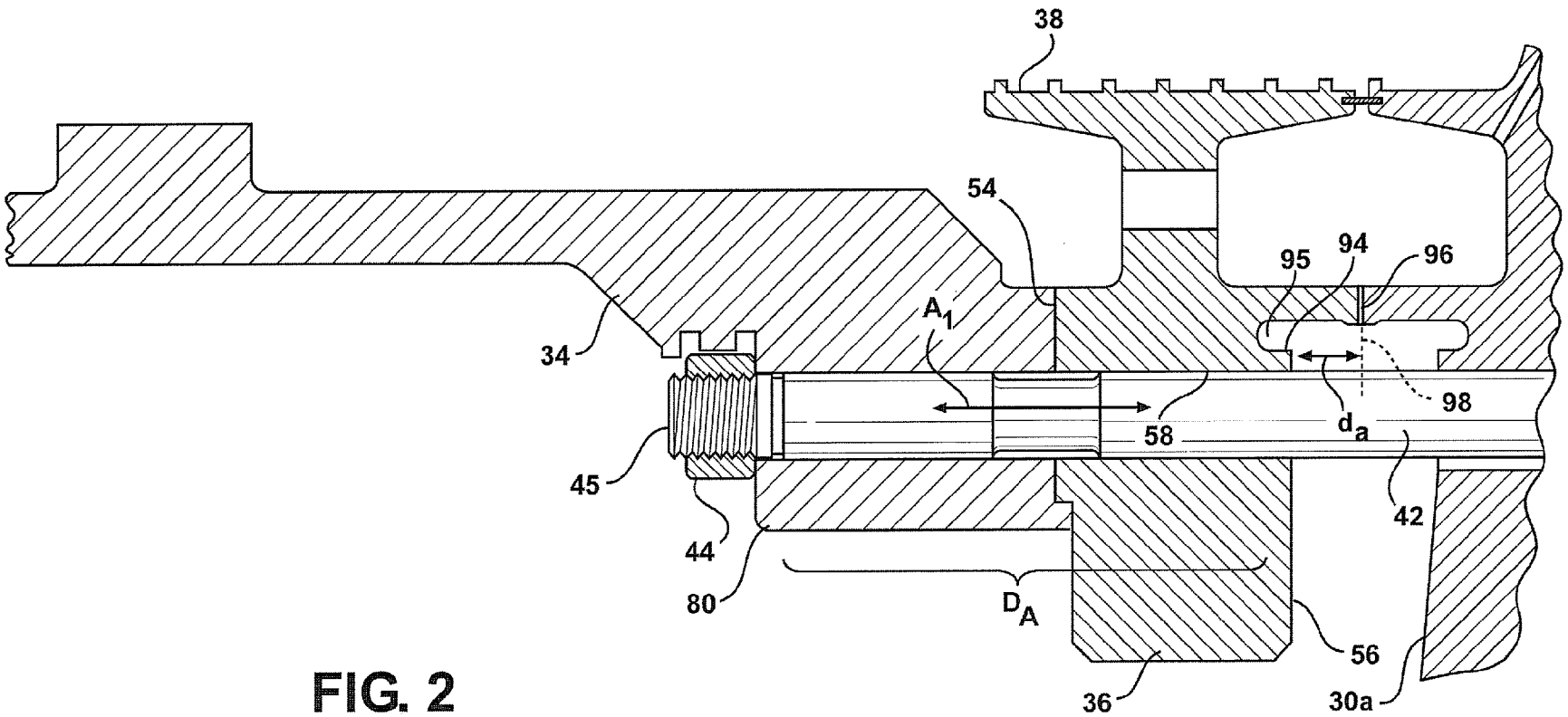
FIG. 2 is an enlarged elevational cross-section view of a disk seal portion of the rotor in the gas turbine engine of FIG. 1.
Figure 6:
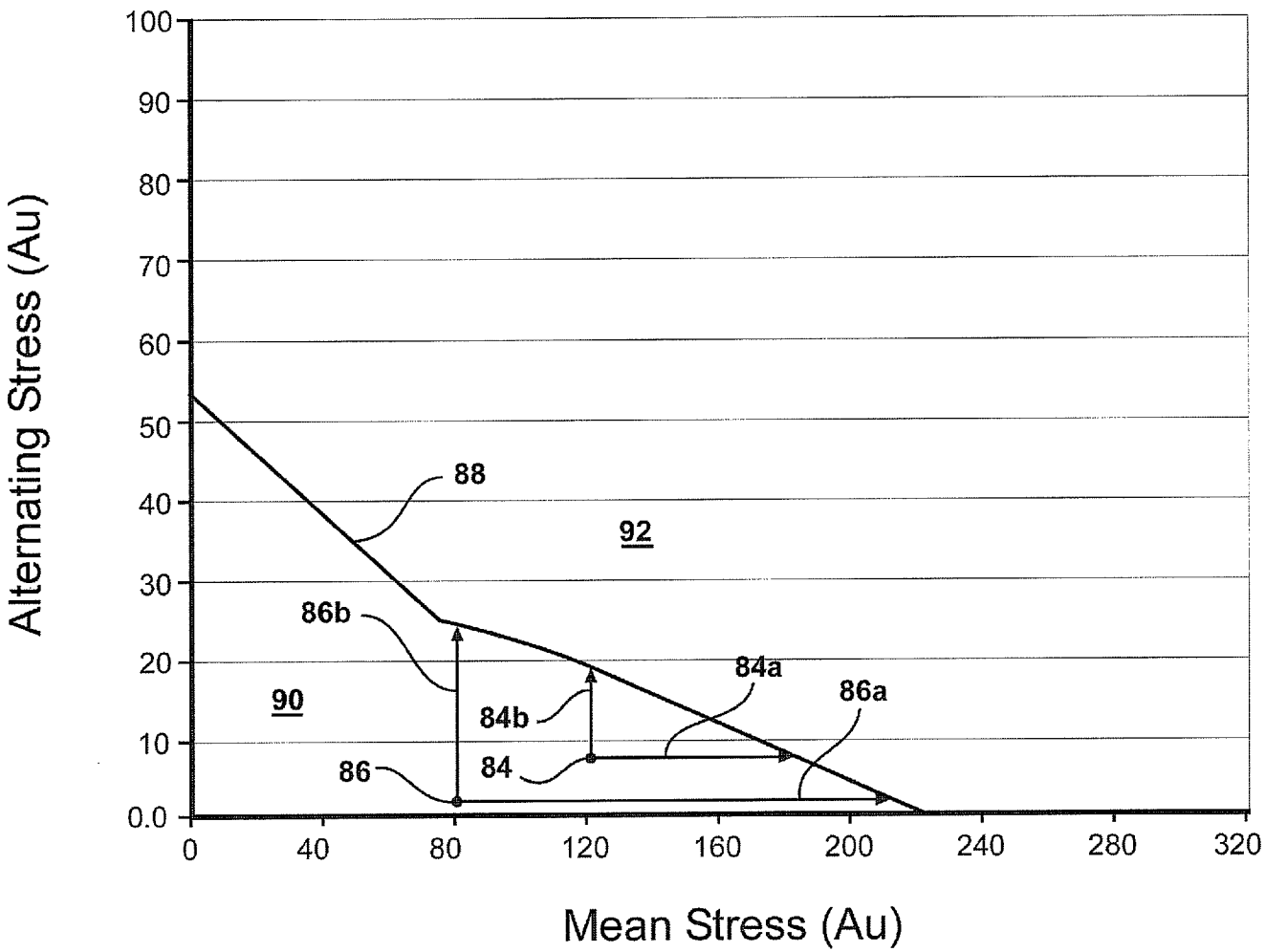
FIG. 6 is a modified Goodman diagram illustrating a comparison of stresses in the spindle bolt structure of FIG. 3 to the stresses in the spindle bolt structure of FIGS. 1 and 2.

FIG. 6 is a modified Goodman diagram illustrating a comparison of the stresses in the spindle bolt structure of FIGS. 1 and 2, identified by a first data point 84, and the stresses in the spindle bolt structure 60 in accordance with the present invention, depicted by second data point 86. The axes of the diagram provide a comparison of the spindle bolt structures on a normalized basis of arbitrary units (Au). The line 88 comprises a separation line defining a separation between a safe zone of operation 90 below the line, and a dangerous zone of operation 92, where any data points depicting operation in the dangerous zone of operation 92 would indicate a likely failure of the component. The difference between the length of the arrows 86*a* and 84*a* represents the increase in the margin of safety of the mean stress provided by the spindle bolt construction 60 of the present invention. The difference between the length of the arrows 86*b* and 84*b* represents the increase in the margin of safety of the alternating stress provided by the spindle bolt construction 60 of the present invention. It can be seen that the present invention provides an improvement (increase) in the margin of safety of the mean stress of approximately 13%, i.e., approximately 28 Au, and an improvement (increase) in the margin of safety of the alternating stress of approximately 25%, i.e., approximately 6 Au. It should be noted that the location of the line 88 may vary during operation of the gas turbine engine, for example by shifting downwardly, and the additional margin of safety depicted by data point 86 represents a reduction in mean and alternating stress that is believed to ensure that the spindle bolt structure 60 remains in the safe operating zone 90 during varying operating conditions of the engine.

It may also be noted that in accordance with the structure disclosed for the present invention, the configuration of the seal disk 36*a* provides a reduced unsupported section of the spindle bolt 42*a* between the first turbine disk 30*a* and the downstream face 56*a* of the seal disk 36*a*. In particular, an inner diameter portion 94*a*, located inwardly from a cavity 95*a* of the seal disk 36*a*, is extended downstream toward an axial location 98*a* of a curvic coupling 96*a* between the seal disk 36*a* and the first turbine disk 30*a*. A distance $d_b$ from a downstream end of the inner diameter portion 94*a* to the axial location 98*a* is substantially less than a corresponding distance $d_a$ (FIG. 2) defined between a downstream end of an inner diameter portion 94, located inwardly from a cavity 95 of the seal disk 36, and an axial location 98 of a curvic coupling 96. Accordingly, the seal disk 36*a* (FIG. 3) may be formed with a greater thickness in the axial direction than the seal disk 36 (FIG. 2) to provide additional support to the spindle bolt 42*a* to reduce centrifugal force loading that may contribute to the stress applied to the spindle bolt 42*a*.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. In a gas turbine engine, a rotor including a plurality of turbine disks for supporting rows of blades, a torque tube located on a compressor side of the turbine disks, and a seal disk located between the torque tube and a first stage turbine disk, a spindle bolt structure comprising:

a spindle bolt extending through the turbine disks and disposed offset from a rotational axis of the turbine disks;

the spindle bolt including a first terminal end located adjacent to the compressor side of the turbine disks; and a sleeve member extending over a portion of the first terminal end of the spindle bolt and embedded within a compressor side of the seal disk for effecting a reduction in fretting movement of the spindle bolt relative to the seal disk.

2. The spindle bolt structure of claim 1, wherein the sleeve member includes an engagement end engaged on a shoulder defined inside the seal disk.

3. The spindle bolt structure of claim 2, wherein the seal disk has opposing axial faces comprising an upstream axial face adjacent to the torque tube and a downstream axial face adjacent to the first turbine disk and a seal disk thickness defined between the axial faces, and the seal disk shoulder is located a distance from the downstream axial face less than one-half the distance between the upstream and downstream axial faces.

4. The spindle bolt structure of claim 1, wherein the sleeve is rigidly affixed at a predetermined axial location on the first terminal end of the spindle bolt.

5. The spindle bolt structure of claim 4, wherein the first terminal end of the spindle bolt comprises a threaded end, and the first terminal end is threadably engaged into the sleeve.

6. The spindle bolt structure of claim 5, wherein the sleeve comprises a generally cylindrical exterior, and including an anti-rotation key between the seal disk and the sleeve.

7. The spindle bolt structure of claim 1, wherein the spindle bolt includes a second terminal end located adjacent an exhaust side of the turbine disks opposite from the compressor side of the turbine disks.

8. The spindle bolt structure of claim 7, wherein the plurality of turbine disks define a rotor and the second terminal end of the spindle bolt is located at a last stage turbine disk.

9. The spindle bolt structure of claim 1, further including a shear bolt offset from the rotational axis and extending through the seal disk and the torque tube for effecting a rigid connection between the seal disk and the torque tube.

10. In a gas turbine engine a rotor including a plurality of turbine disks for supporting rows of blades, a torque tube located on a compressor side of the turbine disks, and a seal disk located between the torque tube and a first stage turbine disk, a spindle bolt structure comprising:

spindle bolts extending through the turbine disks, the spindle bolts being disposed circumferentially around and offset from a rotational axis of the turbine disks;

the spindle bolts including a first terminal end located adjacent to the compressor side of the turbine disks;

a plurality of holes in the seal disk aligned with corresponding holes in the turbine disks for receiving the spindle bolts, each hole in the seal disk comprising a stepped portion defining a shoulder between opposing axial faces of the seal disk;

a sleeve member extending over a portion of the first terminal end of each of the spindle bolts and embedded within a compressor side of the seal disk; and each of the sleeve members including an engagement end engaged on a shoulder within a respective hole in the seal disk for effecting a reduction in fretting movement of the spindle bolt relative to the seal disk.

11. The spindle bolt structure of claim 10, wherein the opposing axial faces of the seal disk comprise an upstream axial face adjacent to the torque tube and a downstream axial face adjacent to the first turbine disk and a seal disk thickness defined between the axial faces, and the seal disk shoulders within the holes of the seal disk are located a distance from the downstream axial face less than one-half the distance between the upstream and downstream axial faces.

12. The spindle bolt structure of claim 10, wherein the sleeves are rigidly affixed at a predetermined axial location on the first terminal end of the spindle bolts.

13. The spindle bolt structure of claim 12, wherein the first terminal end of the spindle bolts comprises a threaded end, and the first terminal ends are threadably engaged into the sleeves.

14. The spindle bolt structure of claim 13, wherein each sleeve comprises a generally cylindrical exterior, and including an anti-rotation key between each sleeve and a respective hole in the seal disk.

15. The spindle bolt structure of claim 10, wherein the spindle bolts include a second terminal end located adjacent an exhaust side of the turbine disks opposite from the compressor side of the turbine disks.

16. The spindle bolt structure of claim 15, wherein the plurality of turbine disks define a rotor and the second terminal end of the spindle bolts is located at a last stage turbine disk.

17. The spindle bolt structure of claim 10, further including a plurality of shear bolts located circumferentially around and offset from the rotational axis and extending through the seal disk and the torque tube for effecting a rigid connection between the seal disk and the torque tube.

* * * * *